US007293572B2

(12) United States Patent
Honkala et al.

(10) Patent No.: US 7,293,572 B2
(45) Date of Patent: Nov. 13, 2007

(54) CLEANING EQUIPMENT FOR CLEANING A MOVING SURFACE PARTICULARLY IN A PAPER MACHINE

(75) Inventors: Tomi Honkala, Jyskä (FI); Jari Laine, Jyskä (FI); Petteri Venetjoki, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 573 days.

(21) Appl. No.: 10/395,471

(22) Filed: Mar. 21, 2003

(65) Prior Publication Data

US 2003/0178048 A1 Sep. 25, 2003

(30) Foreign Application Priority Data

Mar. 22, 2002 (FI) ..... 20025014

(51) Int. Cl.
*B08B 3/00* (2006.01)
*B08B 3/04* (2006.01)
*B08B 9/00* (2006.01)

(52) U.S. Cl. ..... 134/104.2; 134/84; 134/85; 134/104.1; 134/104.2; 134/166 R; 285/225; 285/232; 285/234; 239/106; 118/317

(58) Field of Classification Search ..... 141/133, 141/331; 285/225, 232, 234; 134/85, 104.2, 134/104.1, 166 R, 104; 118/317; 162/48; 239/106
See application file for complete search history.

(56) References Cited

U.S. PATENT DOCUMENTS 2,585,776 A * 2/1952 Vaclav ..... 19/109
4,168,562 A * 9/1979 Maasberg ..... 15/320
4,852,209 A * 8/1989 Svenka et al. ..... 15/308
5,482,093 A * 1/1996 Tremonti et al. ..... 141/98
5,603,775 A 2/1997 Sjoberg
5,644,986 A 7/1997 Gydesen
5,783,044 A 7/1998 Schneider et al.
5,813,087 A * 9/1998 Huffman ..... 15/321
5,879,515 A * 3/1999 Straub et al. ..... 162/275
5,964,956 A * 10/1999 Straub et al. ..... 134/15
5,964,960 A * 10/1999 Boeck ..... 134/34
6,050,392 A 4/2000 Straub
6,364,959 B1 * 4/2002 Straub et al. ..... 134/9
6,468,397 B1 * 10/2002 Chuang ..... 162/199
6,971,503 B2 * 12/2005 Thompson ..... 198/494

FOREIGN PATENT DOCUMENTS

DE 29903890 U1 11/1999
JP 04222729 A * 8/1992
WO 94/12349 6/1994
WO 97/00173 1/1997
WO 0054971 9/2000

* cited by examiner

*Primary Examiner*—Mikhail Kornakov
*Assistant Examiner*—Rita R Patel
(74) *Attorney, Agent, or Firm*—Fildes & Outland, P.C.

(57) ABSTRACT

Cleaning equipment for cleaning a moving surface particularly in a paper machine includes a washing head with a chamber in it opening onto the surface to be cleaned and nozzle elements arranged inside the chamber. The cleaning equipment also includes vacuum means and removal means. The vacuum means are arranged in the washing head. In addition, the washing head is arranged to be movable relative to the removal means that are fitted in a fixed manner.

11 Claims, 5 Drawing Sheets

CLEANING EQUIPMENT FOR CLEANING A MOVING SURFACE PARTICULARLY IN A PAPER MACHINE

FIELD OF THE INVENTION

The present invention relates to cleaning equipment for cleaning a moving surface particularly in a paper machine, which cleaning equipment includes

- at least one washing head, arranged to be moved backwards and forwards transversely relative to the surface, the frame of which washing head, open at both ends, forms a chamber opening onto the surface to be cleaned,
- nozzle elements arranged inside the chamber for cleaning the moving surface,
- vacuum means for creating a suction effect at the first end of the surface side of the said chamber, and
- removal means connected to the second end of the chamber of the washing head, for removing from the washing head the material detached from the surface and collected using the suction effect.

BACKGROUND OF THE INVENTION

WO publication number 94/12349 discloses equipment for cleaning a moving surface. The equipment is intended particularly for cleaning printing rollers, but it is proposed in the publication that it can also be used for cleaning the fabrics of paper machines. In the equipment, there is a washing head, inside which there is at least one high-pressure nozzle. The washing jet created with the aid of the high-pressure nozzle detaches the dirt from the surface being cleaned. Inside the washing head, which it set at a short distance from the surface being cleaned, a suction effect is created, by means of which the wash water and dirt removed are transferred away from the washing head. In order to ensure the transfer of the material, air jets are led from outside the washing head to a gap between the washing head and the surface being cleaned. In addition, the washing head is supported by suitable guides, in order to be movable transversely relative to the surface being cleaned.

The suction is created with the aid of a vacuum unit located far from the washing head. The vacuum effect is transferred to the washing head using a thick vacuum hose, inside of which a narrower hose is also arranged for the wash water. The construction in question is complicated and the necessary vacuum unit must have a large capacity. A filter must also be installed in the vacuum unit, to separate the dirt and water from the air flow. At the same time, the thick vacuum hose must be reinforced throughout because of the vacuum, which, however, reduces its movability. Thus, it is usually impossible to utilize the said equipment in connection with wide paper machines. The vacuum hose also limits the location of the washing head. Over time, the long vacuum hose also collects dirt, which can only be removed by detaching, or even replacing the vacuum hose. In addition, the external pipes of the washing head that form the air jets are sensitive to breakage and particularly collect dirt. In addition, both the washing head and the aforesaid pipes must be dimensioned and shaped separately for each curved surface.

SUMMARY OF THE INVENTION

The invention is intended to create a new type of cleaning equipment for cleaning a moving surface particularly in a paper machine, which can be more freely positioned than before, but which is simpler and more powerful than before.

The characteristic features of the present invention are provided by cleaning equipment for cleaning a moving surface particularly in a paper machine, which cleaning equipment includes

- at least one washing head, arranged to be moved backwards and forwards transversely relative to the surface, the frame of which washing head, open at both ends, forms a chamber opening onto the surface to be cleaned,
- nozzle elements arranged inside the chamber for cleaning the moving surface,
- vacuum means for creating a suction effect at the first end of the surface side of the said chamber, and
- removal means connected to the second end of the chamber of the washing head, for removing from the washing head the material detached from the surface and collected using the suction effect, and is characterized in that the vacuum means are arranged in the washing head and the washing head is arranged to be movable relative to the removal means that are fitted in a fixed manner, and which comprise essentially a collection trough or similar that extends over the entire transverse length of the surface.

The vacuum means may comprise one or several arranged to form an extension to the body of the washing head, or an extension of the previous ejector, as part of the body.

The washing head may be set in such a way that its first end is lower than its second end.

The cross-section of the collection trough is essentially circular and part of the body of the washing head may extend inside the collection trough in a direction essentially tangential to the collection trough.

The collection trough may be made from sheet metal and its cross-sectional diameter increases towards one or both ends of the collection trough.

The connection parallel to the body can be arranged to the first end of the body of the washing head, for feeding a medium between the body and the surface to be cleaned essentially over the entire area of the edges of the body of the said end.

The connections can be divided into at least two parts, in such a way that the mediums fed to the front edge and the rear edge of the body in the direction of movement of the surface are different.

The medium fed at the front edge may be steam and that at the rear edge may be compressed air.

The connections may be connected to a space, which is formed between the body and the end piece comprising the connections.

A washing station may be arranged at at least one end of the collection trough, for washing the washing head from both inside and outside. The washing station may include a cage formed from the washing agent connections, into which the washing head is arranged to be moved, in order to wash the washing head.

In the cleaning equipment according to the invention, a suction effect is achieved in a completely new and surprising manner. In addition, the removal means are simple and the removal of the material is certain. Further, the removal means and particularly the washing head can be freely located, so that the equipment can be utilized even in cramped positions. In addition, the width of the surface being cleaned is, in principle, unlimited. In other words, a single type of washing head can be used to clean moving surfaces of different widths, with small changes.

These and other features and advantages of the invention will be more fully understood from the following detailed description of the invention taken together with the accompanying drawings.

DETAILED DESCRIPTION OF THE INVENTION

Figure 1:
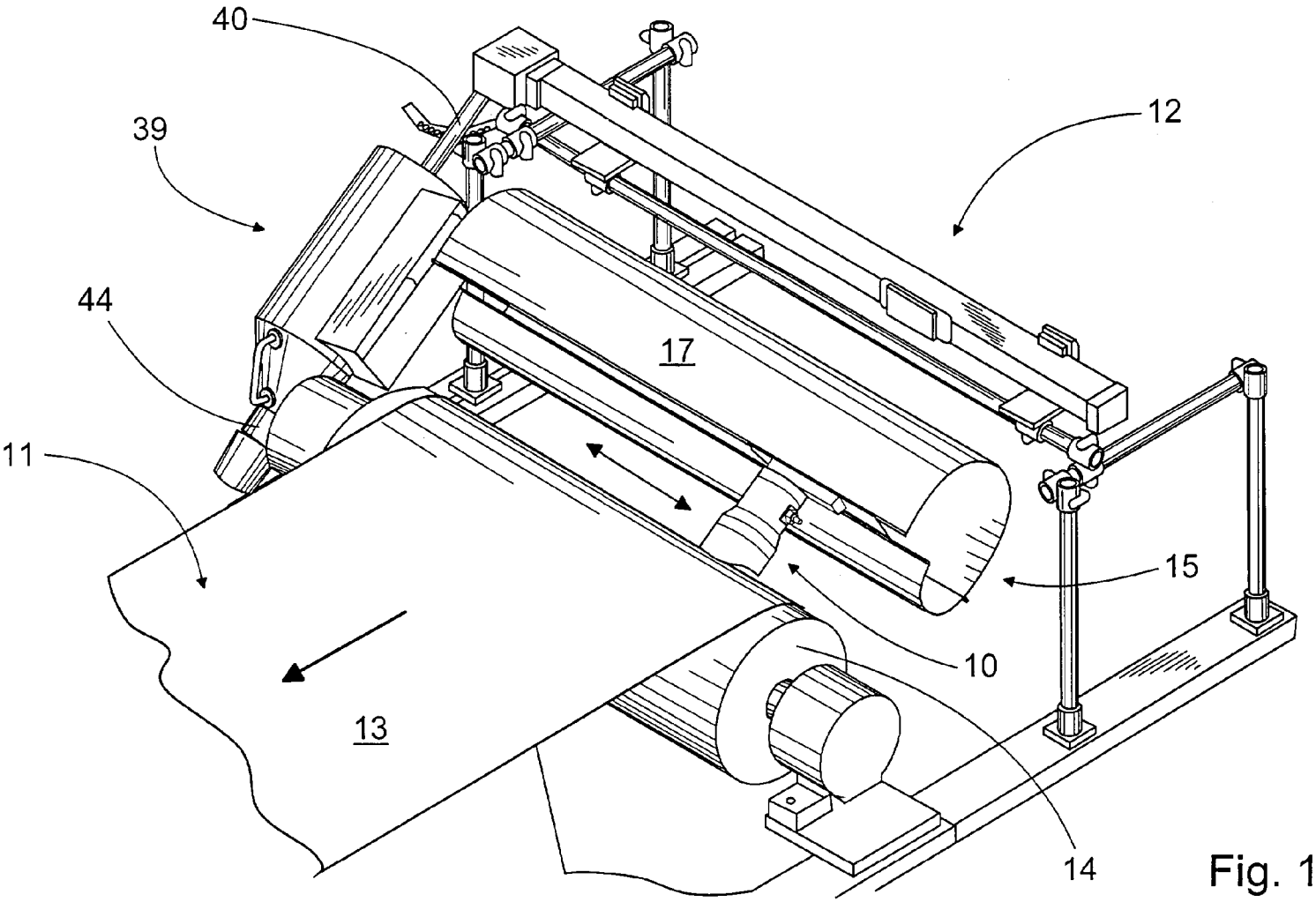
FIG. 1 shows a schematic diagram of the cleaning equipment according to the invention, fitted in connection with a pilot paper machine.

FIG. 1 shows the cleaning equipment according to the invention fitted to a pilot paper machine, which has a width of about 1000 mm. Corresponding cleaning equipment can equally well be used in production machines, the width of which is nowadays more than 10000 mm. Besides paper machines, the cleaning equipment can also be advantageously applied to board machines and other similar machines, in which there are many wide moving surfaces to be cleaned. The cleaning equipment usually includes one washing head 10, arranged to be moved backwards and forwards transversely relative to the surface. There can, however, be several washing heads. In FIG. 1, the support of the washing head 10 is shown schematically, as is the rest of the construction of the paper machine. In practice, the support is based on suitable guides 12 and operating devices, by means of which the washing head 10 is moved backwards and forwards across the surface 11 being cleaned. In addition, the necessary connections to the washing head for creating a cleaning effect (not shown) are attached to the guides. In a production machine, the guides are preferably attached to the existing frame structures. For reasons of clarity, FIG. 1 also does not show the supporting elements between the guides and the washing head.

In FIG. 1, the cleaning equipment is located in connection with the moving fabric 13 at the roll 14 supporting the fabric 13. In the position in question the dirty surface of the fabric opens in a way, which facilitates the removing of the dirt. Thanks to its small size, the washing head can be located in positions in which the angle of coverage of the fabric relative to the roll is small. In principle, the washing head can also be used to clean the fabric in an unsupported gap, but preferably there should be some support behind the fabric, to ensure undisturbed operation.

The cleaning equipment also includes removal means 15 connected to the washing head 10, for transferring material, detached from the surface and collected by the suction effect, away from the washing head 10. According to the invention, the support of the washing head is separate to that of the removal means. Thus, it is possible to make the washing head compact and thus easily moved and located. The construction of the removal means is examined later in greater detail.

Figure 2:
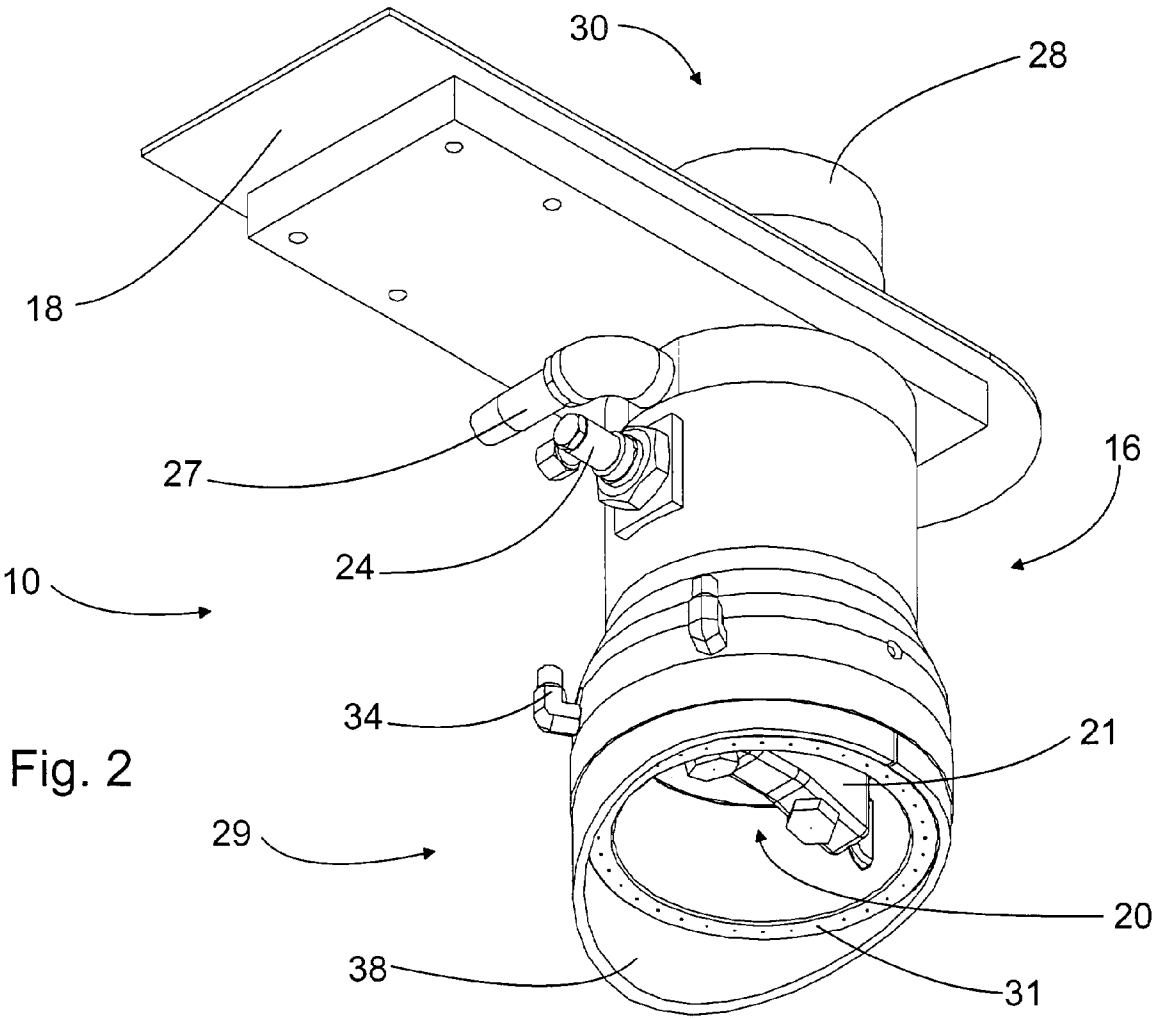
FIG. 2 shows a perspective view of the washing head belonging to the cleaning equipment according to the invention.
Figure 3:
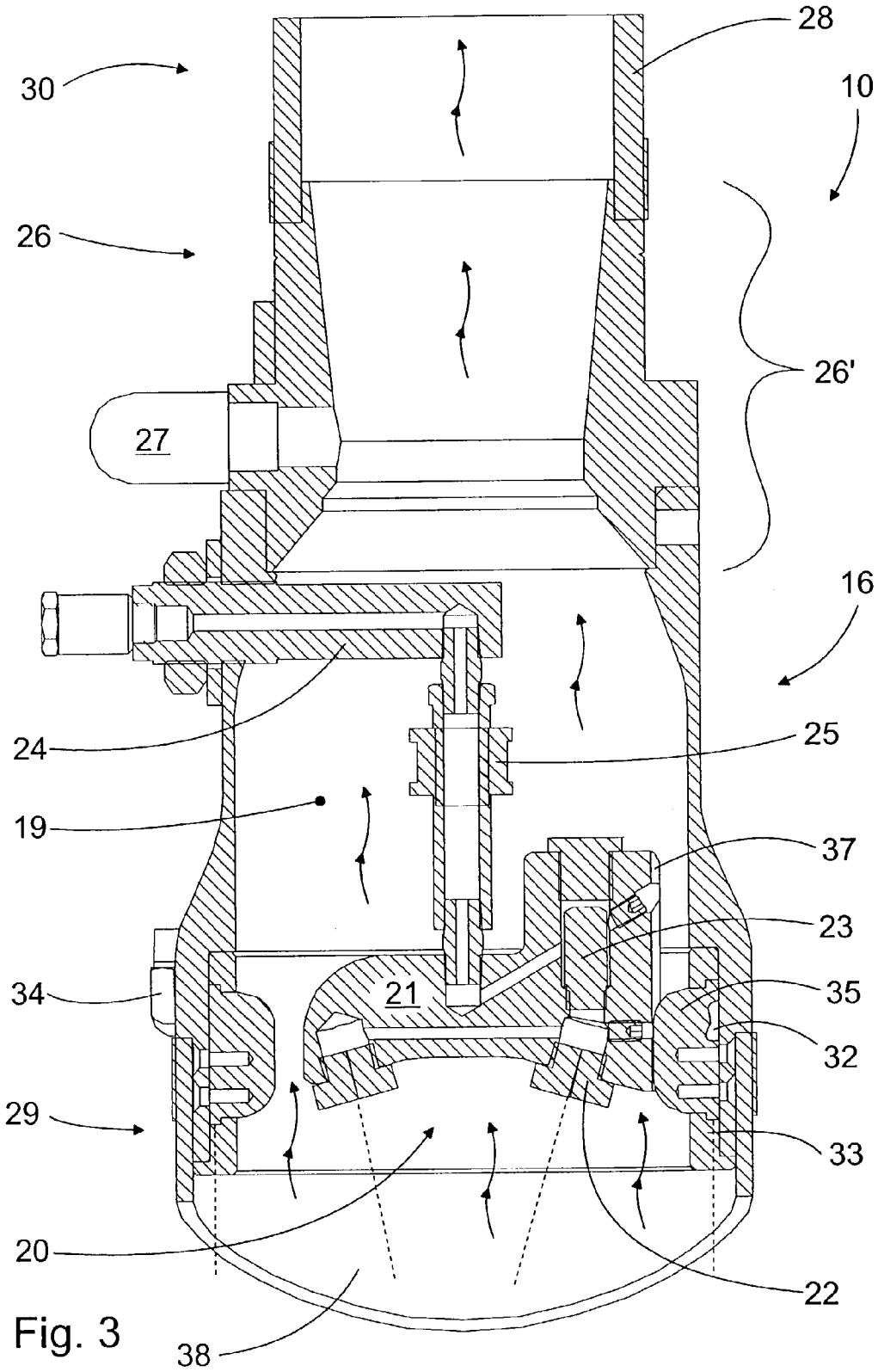
FIG. 3 shows a cross-section of the washing head of FIG. 2.

FIG. 2 shows in its entirety the washing head according to the invention, which is simpler and smaller than known solutions. Nevertheless, it includes a significant share of the components of the entire cleaning equipment. According to the invention, the vacuum devices 26 are surprisingly arranged in the washing head 10 (FIG. 3). Thus, the vacuum hose according to the prior art is unnecessary and in other ways too the construction of the washing head is new. In addition, the washing head is arranged to be movable relative to the removal means, which are installed to be fixed. This simplifies the construction of the necessary guides and otherwise assists the moving of the washing head. According to the invention, the removal means 15 are formed essentially by a collection trough 17 or similar (FIG. 1) extending over the entire transverse length of the surface. In FIG. 2, a special flange 18 is also attached to the washing head 10, which flange seals the washing head into the collection trough 17. In some embodiments the flange is unnecessary, while in some it may be necessary to seal (not shown) the entire length of the collection trough.

FIG. 3 shows a cross-section of the washing head 10 of FIG. 2 without the aforementioned flange. According to the figure, there is a body 16 open at both ends in the washing head 10, which forms a chamber 19 opening onto the surface being cleaned. Inside the chamber 19 nozzle elements 20 are arranged for cleaning the moving surface. In this case, the nozzle elements 20 are arranged as a separate nozzle frame 21, in which there are two high-pressure nozzles 22 and a filter 23. The high-pressure nozzles 22 are aligned at a suitable angle, in order to achieve a washing result as good as possible. In addition, the nozzle frame 21 is connected to a high-pressure water connection 24 by means of a quick-release connector 25. Thus, the nozzle frame 21 with the high-pressure nozzles 22 and filter 23 can be rapidly detached. At the same time, the high-pressure nozzles can be changed even while the paper machine is running, with practically no deterioration in the wash result. The small and flexibly shaped nozzle frame 21 is essentially in the centre of the chamber 19, so that it has little effect on the air flow. In FIG. 2, the air flow is shown with arrows and the various jets with broken lines. The same reference numbers are used for components that are functionally similar.

The vacuum means are used to create a suction effect at the first end of the chamber at the surface side. Thus, both the water sprayed by the nozzle elements and the dirt detached from the surface are removed from the vicinity of the surface. This avoids the surface becoming dirtied again and a mist forming in the surroundings. As the vacuum means are in the washing head according to the invention, it is possible to create and regulate the vacuum more easily and precisely than previously. Generally, the vacuum means 26 are formed by one or several ejectors 26'. There are no moving parts in the ejector and to be able to operate it only needs compressed air, which is directed into the ejector 26' through a compressed air connection 27. However, by means of the ejector, not only is a significant vacuum created, but also a powerful air flow after the ejector. According to FIG. 3, the ejector 26' is arranged as a continuation of the body 16 of the washing head 10, forming part of the body. Thus, the washing head is made advantageously short. After the ejector 26', it is possible to add an extension piece 28, the length and shape of which can be varied to determine the desired exhaust direction. The body, ejector, and possible extension piece are attached tightly to each other by means of suitable attachments. If necessary, the ejector can easily be changed.

In practice, the ejector is used to create a suction effect in the chamber, which becomes a blast effect after the ejector. Thus the washing liquid and the dirt are simply and effectively removed from both the surface and the washing head itself. By means of the ejector, such a good output is achieved even without any auxiliary devices that the washing head can be placed in almost any position at all. Generally, the washing head 10 is placed in such a way that its first head 29 is lower than its second head 30, according to FIG. 1. Thanks to the powerful exhaust, the collection trough can be located higher than the washing head, which would be preferable in most positions, but which is impossible using the prior art. The basic shape of the cross-section of the collection trough 17 is generally essentially circular and part of the washing head 10 extends inside the collection trough 17 in an essentially tangential direction to the collection trough 17 (FIG. 1). In that case, the material being removed is moved certainly to the collection trough, in which the kinetic energy of the material subsides. This substantially reduces misting. In the collection trough, there is also a gap, which permits the movement of the washing head. By means of the shape of the extension piece and the collection trough, the material can also be directed towards the end of the collection trough, for removal from the cleaning equipment. The collection trough is preferably made form sheet metal, making it light and easy to shape. The removal of the material can be assisted by shaping the collection trough in such a way that the diameter of its cross-section increases towards one, or both of its ends. There is then a suitable slope to the collection trough, so that the material at least partly flows by gravity. The removal can be improved, for example, with washing jets (not shown).

Generally the suction effect created by the ejector is so powerful that it is sufficient to suck essentially all the loose material from the area of the washing head. In order to improve and ensure the operation of the washing head, connections 31 running essentially parallel to the body 16 are arranged in the first end 29 of the body. A medium is fed through the connections between the body and the surface being cleaned, essentially over the entire area of the edges of the said end of the body. The medium then seals the chamber with the surface, thus preventing misting to the surroundings. In practice, the cleaning effect can be further improved by dividing the connections into at least two parts, in such a way that mediums fed to the front edge and rear edge of the body, in the direction of movement of the surface being cleaned, are different. In practice, the medium fed at the front edge is preferably steam and that at the rear edge is correspondingly compressed air. The steam fed to the front edge softens both the surface being cleaned and the dirt, which facilitates cleaning.

Figure 4:
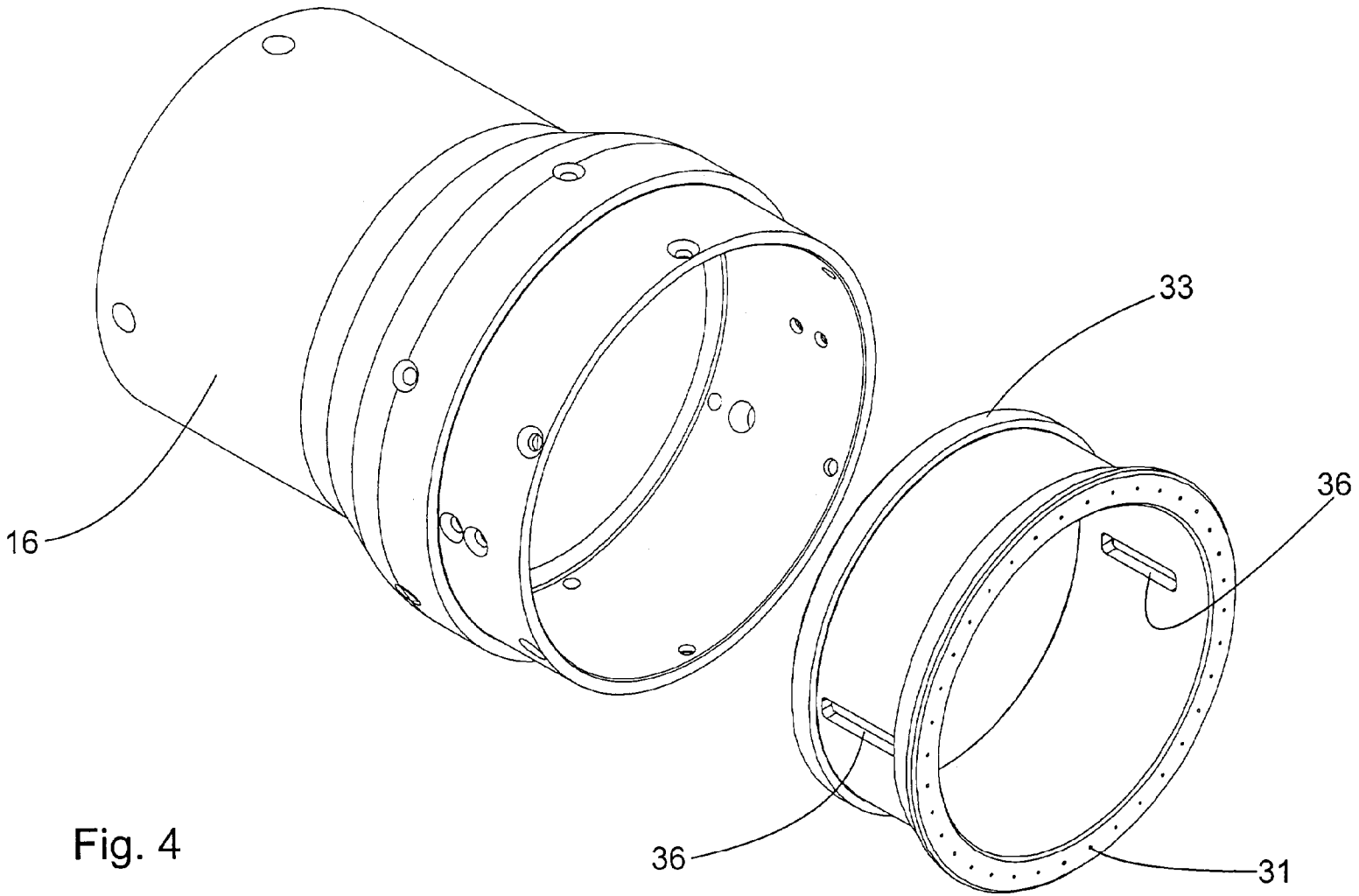
FIG. 4 shows a perspective view of the two main components of the body of the washing head, separated from each other.

In the embodiment shown, the connections 31 are connected to a space 32, which is formed between the frame and the end piece 33 including the connections 31. FIG. 4 shows the body 16 and the end piece 33 separated from each other. According to the example, connected to the space 32 is a connection 34 for the medium, form which the fed medium spreads into the space 32, distributing itself evenly to all the connections 31. At their simplest, the connections 31 are small boreholes in the end piece 33, but separate nozzles can also be used. When using two mediums, the space is divided into two separate parts. In the embodiment shown, the division is made by means of two wedges 35, which are placed in the openings 36 in the end piece 33 and secured to the body 16 with screws. Besides the division, the wedges also attach the end piece to the body. If necessary, some suitable sealing agent can be used between the components. The nozzle frame 21 is also shaped in such a way that the wedge 35 fits into a groove 37 in the nozzle frame 21. Thus the wedge prevents the nozzle frame 21 from rotating, while nevertheless permitting the nozzle frame 21 to be detached without the use of tools.

Generally, the roll end of the body is straight, so that the washing head can be used in connection with surfaces of different curvatures. Application-specific adjustment is achieved by means of an elastic seal 38, which is shaped according to the particular surface. In FIG. 2, the seal 38 is shaped in such a way that the front edge of the washing head 10 is closer to the surface, so that the effect of the steam is exploited as fully as possible. Correspondingly, the seal 38 is longer at the rear edge. In addition, it should be noted that the medium is fed to the inside of the seal 38 (FIG. 2). Thus the washing is separated as well as possible from the surroundings. Thanks to the seal, the washing head can be positioned even very closely to the surface, without the washing head breaking.

Figures 5A, 5B:
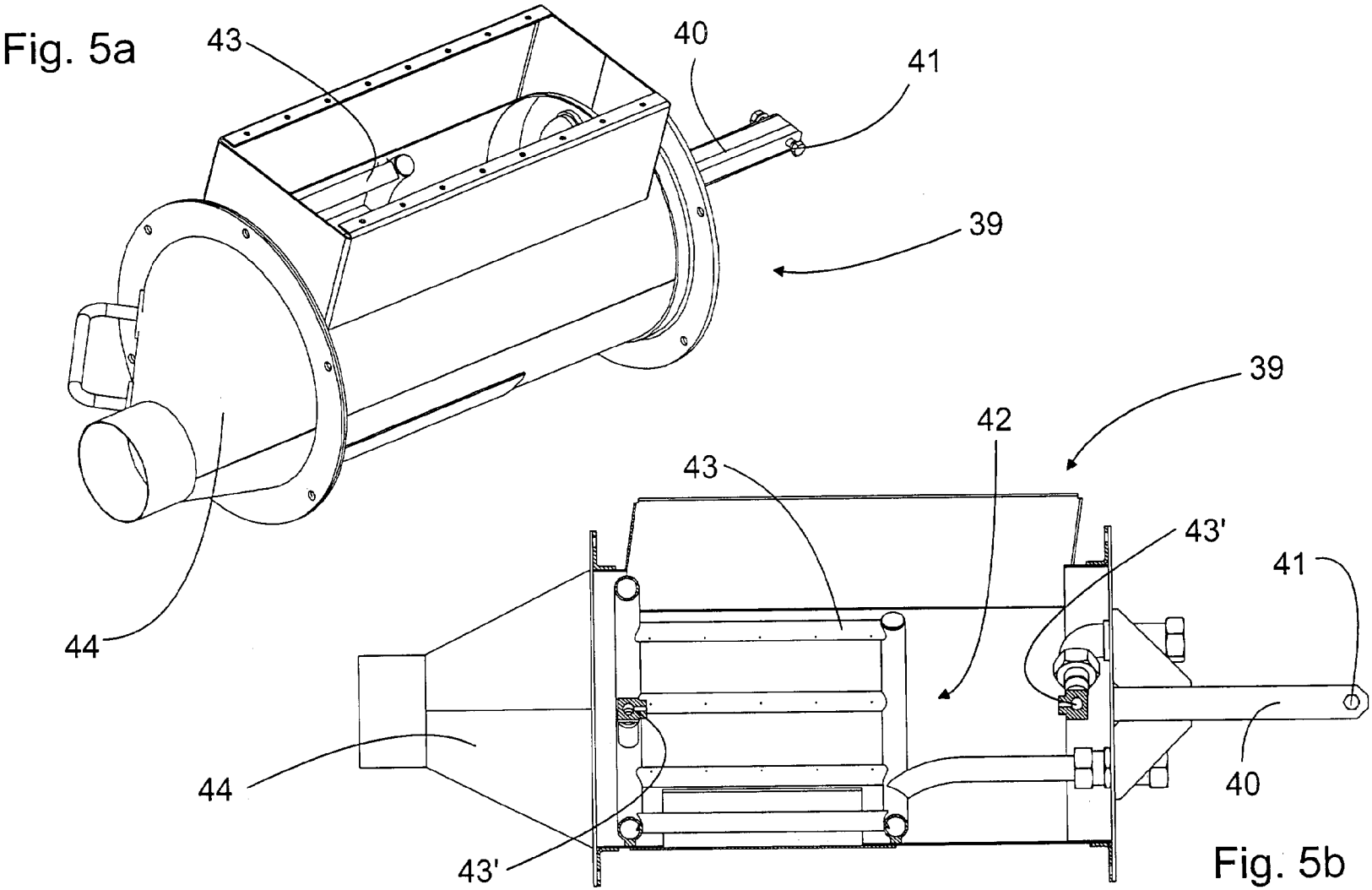
FIG. 5*a* shows a perspective view of the washing station according to the invention, detached from the cleaning equipment.
FIG. 5*b* shows a cross-section of the washing station of FIG. 5*a*.

FIG. 1 also shows a washing station 39 located at the end of the collection trough 17. The washing station is used to wash the washing head from both inside and outside and it is located outside the surface being cleaned. Thus dirt that may collect of top of the washing head is easily removed. At the same time, it is possible to wash the chamber. FIG. 5*a* shows the detached washing station 39. The washing station is preferably supported rotatably on the cleaning equipment, so that the washing station itself can be cleaned and the washing head can be serviced when it has moved to its washing station. For this purpose, there is a suitable pivot pin 41 in the support bar 40 of the washing station 39. The washing station can be supported rotatably in some other suitable manner. FIG. 5*b* shows a cross-section of the washing station 39 of FIG. 5*a*. In this case, the washing station 39 includes a cage 42 formed of pipe-like washing agent connections 43, the washing head being arranged to be movable inside which for washing the washing head. The pipe-like washing agent connections 43 of the cage 42 wash the washing head from the outside. In addition, in the centre of both ends of the cage 42 there are longitudinal washing agent connections 43', which wash the washing head from the inside. The washing station is preferably positioned at least partly at an angle, so that the washing liquid and dirt will flow in a controlled manner out of the end funnel 44 of the washing station.

One tested ejector is manufactured from stainless steel and has the model code Brauer SS60A. Using the said ejector it is possible to achieve an air flow of 10 $m^3$ per minute at a pressure of 5 bar. Correspondingly, at the same time an air flow of 1 $m^3$ is achieved inside the ejector, in which case a sufficient vacuum effect is created. Correspondingly, the largest internal diameter of the chamber of the washing head is 110 mm and the overall length including the ejector, extension piece, and seal is 320 mm. This is thus a small and compact washing head, by means of which a good wash effect is achieved. This is possible, as thanks to the powerful suction and the sealing, it is possible to use plenty of steam and high-pressure washing liquid.

The cleaning equipment according to the invention is more versatile and powerful than conventional equipment, but is nevertheless simpler than previously. The washing head is easy to start up, operate, and service, thanks to its unique construction and washing station. In addition, the washing head can be used in different applications, as the collection trough can be located freely. The vacuum means located in the washing head, by means of which a powerful and easily regulated suction effect is created, are also significant. At the same time a powerful blast effect is created for removing material from the washing head.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. Cleaning equipment for cleaning a moving surface particularly in a paper machine, which cleaning equipment includes at least one washing head having a body, said at least one washing head arranged to be moved backwards and forwards transversely relative to the surface, the frame of which washing head, open at both ends, forms a chamber opening onto the surface to be cleaned, nozzle elements arranged inside the chamber for cleaning the moving surface, vacuum means for creating a suction effect at the first end of the surface side of the said chamber, and removal means connected to the second end of the chamber of the washing head, for removing from the washing head the material detached from the surface and collected using the suction effect, characterized in that the vacuum means comprises at least one ejector and is arranged in the washing head, wherein a vacuum is generated inside the washing head by leading compressed air to the at least one ejector, and the washing head is arranged to be movable relative to the removal means that is fitted in a fixed manner, and which removal means comprises essentially a collection trough or similar that extends over the entire transverse length of the surface, and in the collection trough, there is also a gap, which permits the movement of the washing head, and part of the washing head extends inside the collection trough through said gap.

2. Cleaning equipment according to claim 1, characterized in that the at least one ejector is arranged to form an extension to the body of the washing head, or an extension of the previous ejector, as part of the body.

3. Cleaning equipment according to claim 1, characterized in that the washing head is set in such a way that its first end is lower than its second end.

4. Cleaning equipment according to claim 1, characterized in that the cross-section of the collection trough is essentially circular and part of the body of the washing head extends inside the collection trough in a direction essentially tangential to the collection trough.

5. Cleaning equipment according to claim 1, characterized in that the collection trough is made from sheet metal and its cross-sectional diameter increases towards one or both ends of the collection trough.

6. Cleaning equipment according to claim 1, characterized in that connection parallel to the body is arranged to the first end of the body of the washing head, for feeding a medium between the body and the surface to be cleaned essentially over the entire area of the edges of the body of the said end.

7. Cleaning equipment according to claim 6, characterized in that the connections are divided into at least two parts, in such a way that the mediums fed to the front edge and the rear edge of the body in the direction of movement of the surface are different.

8. Cleaning equipment according to claim 7, characterized in that the medium fed at the front edge is steam and that at the rear edge is compressed air.

9. Cleaning equipment according to claim 6, characterized in that the connections are connected to a space, which is formed between the body and the end piece comprising the connections.

10. Cleaning equipment according to claim 1, characterized in that a washing station is arranged at least at one end of the collection trough, for washing the washing head from both inside and outside.

11. Cleaning equipment according to claim 10, characterized in that the washing station includes a cage formed from the washing agent connections, into which the washing head is arranged to be moved, in order to wash the washing head.

* * * * *